US006286728B1

(12) United States Patent
Driskell et al.

(10) Patent No.: US 6,286,728 B1
(45) Date of Patent: Sep. 11, 2001

(54) SHROUD COVER FOR TRIGGER SPRAYER

(75) Inventors: William L. Driskell, Lee's Summit; Philip Dimaggio, Kansas City, both of MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/754,280

(22) Filed: Jan. 5, 2001

(51) Int. Cl.[7] ..... B67D 5/40

(52) U.S. Cl. ..... 222/383.1; 222/182; 222/207; 239/333

(58) Field of Search ..... 222/383.1, 182, 222/207; 239/333, 493; 264/328.1, 318

(56) References Cited

U.S. PATENT DOCUMENTS

| | | | | |
|---|---|---|---|---|
| 4,191,313 | * | 3/1980 | Blake et al. | 222/335 |
| 4,204,614 | * | 5/1980 | Reeve | 222/153 |
| 4,257,539 | * | 3/1981 | Cary et al. | 222/182 |
| 4,346,821 | * | 8/1982 | Wesner et al. | 222/153 |
| 4,506,805 | | 3/1985 | Marcon . | |
| 4,940,186 | * | 7/1990 | Tada | 239/337 |
| 5,172,836 | * | 12/1992 | Warner | 222/383 |
| 5,356,049 | | 10/1994 | Harris et al. . | |
| 5,366,121 | | 11/1994 | Foster et al. . | |
| 5,425,482 | * | 6/1995 | Foster et al. | 222/207 |
| 5,507,437 | | 4/1996 | Foster et al. . | |
| 5,656,227 | * | 8/1997 | Foster | 264/328.1 |
| 5,704,521 | * | 1/1998 | Grogan et al. | 222/383.1 |
| 5,749,501 | * | 5/1998 | Maas et al. | 222/384 |
| 5,975,376 | * | 11/1999 | Chelupsky et al. | 222/383.1 |
| 5,984,149 | * | 11/1999 | Thanisch et al. | 222/340 |
| 5,984,151 | | 11/1999 | Lohrman et al. . | |
| 6,003,738 | * | 12/1999 | Foster et al. | 222/384 |
| 6,216,912 | * | 4/2001 | Keung et al. | 222/1 |

* cited by examiner

*Primary Examiner*—Kevin Shaver
*Assistant Examiner*—Frederick C Nicolas
(74) *Attorney, Agent, or Firm*—Dykema Gossett PLLC

(57) ABSTRACT

An open-fronted shroud covers a pump body of a trigger actuated pump sprayer and comprises a one-piece cover of at least one molded thermoplastic material having an upper section and a lower section, the cover having a rearwardly extending portion defining a saddle for supporting the pump sprayer on top of the operators hand during use. The upper and lower sections are interconnected by an integral hinge at a terminal end of the rearwardly extending portion for pivotal movement between an open position of the sections during molding and a closed position when mounted on the pump body during use.

13 Claims, 2 Drawing Sheets

FIG. 1
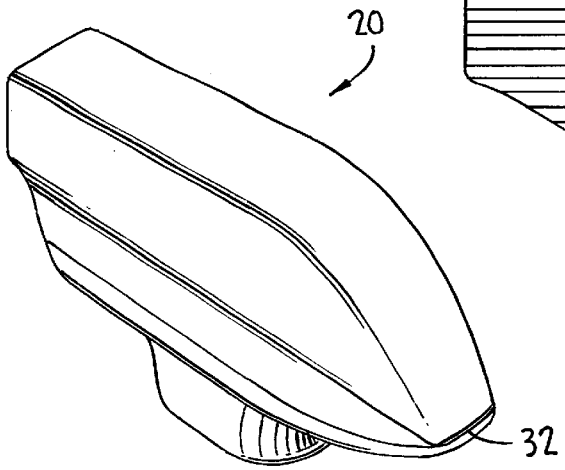
FIG. 2
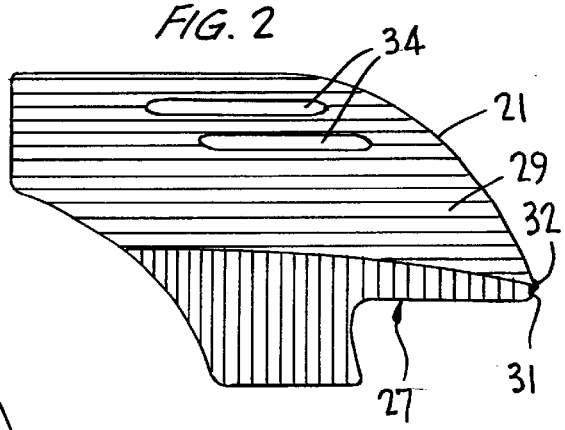
FIG. 3
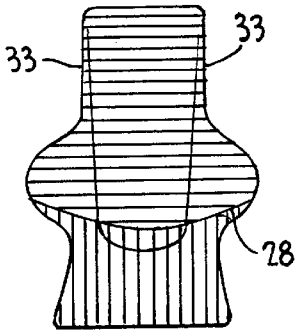
FIG. 4
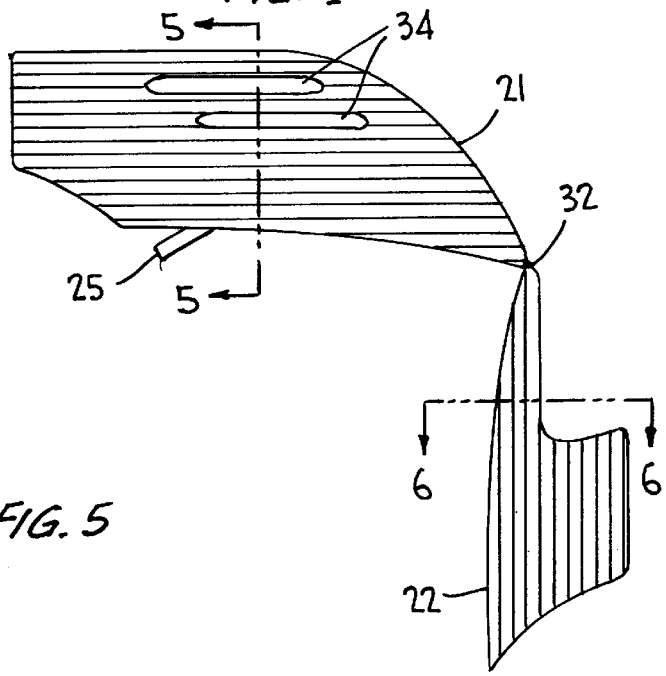
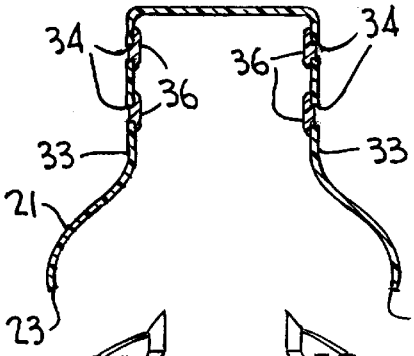
FIG. 5
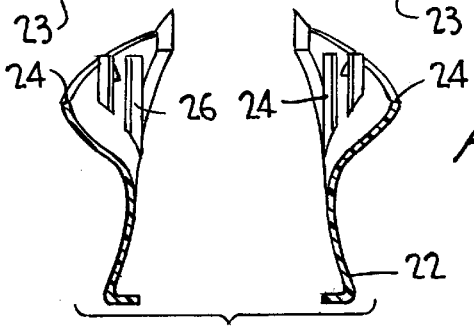
FIG. 6

SHROUD COVER FOR TRIGGER SPRAYER

BACKGROUND OF THE INVENTION

This invention relates generally to a shroud cover for a trigger actuated pump sprayer, and more particularly to a shroud of one-piece molded thermoplastic material forming an articulated clamshell-like element.

Many of the known trigger actuated pump sprayers have a pump body of a molded thermoplastic material which includes a pump cylinder for the reception of a reciprocable pump piston which together therewith defines a variable volume pump chamber. The pump body includes an inlet passage leading to the pump chamber and a discharge barrel defining a discharge passage leading from the pump chamber and terminating in a nozzle on which a nozzle cap is mounted having a discharge orifice. A trigger lever is pivotally mounted to the pump body for actuating the pump piston upon a squeezing of the trigger, and a container closure cap is coupled to the pump body for mounting it to a container of liquid to be dispensed. One type of trigger sprayer has an open-fronted shroud which is provided for covering the pump body, the shroud being snap-fitted to the pump body in a known manner.

The shroud cover may be provided with a rear saddle, i.e., a rearwardly extending horizontal wall defining a shelf which rests upon the upper side of the operator's hand between the thumb and forefinger for supporting the trigger sprayer and the liquid filled container to which is it mounted. Examples of such ergonomic sprayers are found in design patents 409,487, 409,917 and 409,918, commonly owned herewith.

Such an open-fronted shroud having a rear ergonomic feature is becoming more difficult to mold as a unitary one-piece member. Adding to the complexity of molding the shroud as a one-piece construction is the provision of additional side ergonomic features such as that disclosed in co-pending application Ser. No. 09/660,476, filed Sep. 12, 2000, entitled Ergonomic Trigger Sprayer Having Side Saddle Supports, commonly owned herewith.

Moreover, there are demands for contrasting two-tone colors for such open fronted shrouds having at least a rear ergonomic feature. Or it is desirable for the lower portion of the shroud to be of a softer and more compliant thermoplastic elastomer compared to the remaining upper portion of the shroud, to thereby provide a "soft feel" or "soft touch" for the operator during use. A further desirable feature for the shroud design is side striping or the like on the upper portion of the shroud for customer appeal purposes.

Heretofore the approach taken in providing ergonomic shroud covers having one or more of the advantages or features aforedescribed, was to mold the shroud as two units, upper and lower, and thereafter snap-fitting the units together. This approach, however, is labor and capital intensive requiring not only additional molding steps but added sub-assembly procedures.

SUMMARY OF THE INVENTION

It is an object of the present invention to solve the problems noted above by the provision of a unitary, articulated shroud cover for a trigger actuated sprayer which is of a thermoplastic material or materials of ergonomic design having a rear saddle section for supporting the trigger sprayer on the top of the operator's hand when the sprayer is mounted in use on the container of product to be dispensed. The articulated one-piece shroud comprises clamshell-like sections interconnected by a living integral hinge located at the terminal end of the rear saddle. The shroud may be injection molded using a thermoplastic of a given color and a given hardness. Otherwise, the thermoplastic material of the lower or base section of the shroud may be softer and more compliant elastomer compared to the thermoplastic material of the upper or crown section of the shroud, the sections being co-injection molded using known techniques.

Moreover, the thermoplastic materials used in the co-injection process may be of different and contrasting colors so as to effect a two tone shroud cover for market appeal.

Still further the crown section of the shroud may be provided with side slits such that during the co-injection molding process portions of elastomer material of the base section extend therefrom and underlie the slits so as to be visible therethrough from an exterior side of the crown section. The articulated shells or sections forming the shroud may be latched together during the assembly process along the confronting edges thereof.

Other objects, advantages and novel features of the invention will become more apparent from the following detailed description of the invention when taken in conjunction with the accompanying drawings.

BRIEF DESCRIPTION OF THE DRAWINGS

FIG. 1 is a left perspective view of the open-fronted shroud cover according to the invention;

FIG. 2 is a left side elevational view thereof shown with the articulated sections closed together;

FIG. 3 is a rear elevational view of the shroud of FIG. 2;

FIG. 4 is a view similar to FIG. 2 showing the shroud sections relatively open;

FIG. 5 is a cross-sectional view taken substantially along the line 5—5 of FIG. 4;

FIG. 6 is a cross-sectional view taken substantially along the line 6—6 of FIG. 4;

DETAILED DESCRIPTION OF THE INVENTION

Figure 7:
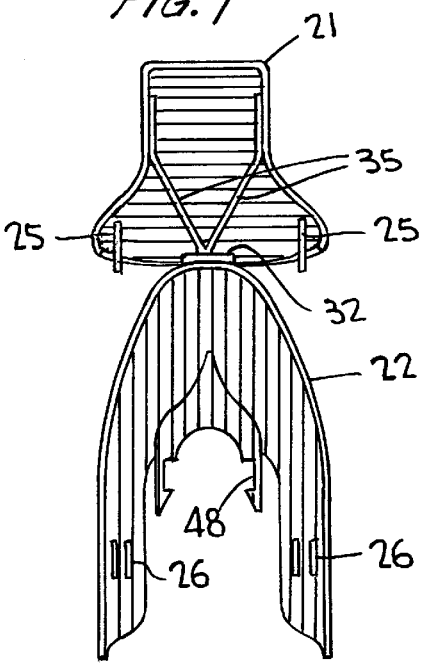
FIG. 7 is a front elevational view of the open shroud of FIG. 4.
Figure 8:
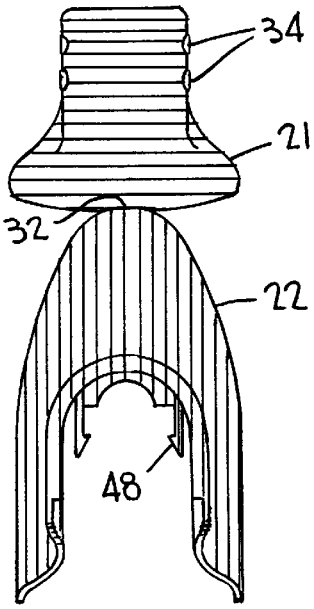
FIG. 8 is a rear elevational view of the open shroud of FIG. 4.

Turning now to the drawings wherein like reference characters refer to like and corresponding parts throughout the several views, the shroud cover according to the invention is generally designated 20 in the drawings which is illustrative of the invention although it is to be made clear that shrouds of different shapes and designs from that disclosed herein are made possible without departing from the scope of the invention.

The shroud cover is injection molded as a one-piece element of one or more thermoplastic materials or one or more thermoplastic elastomer materials in the form of an articulated pair of clamshell-like sections 21 and 22. As shown in FIGS. 5 and 6, sections 21 and 22 are substantially cup-shaped with free edges 23 of section 21 and free edges 24 of section 22 being spaced apart from one another in the open position of FIG. 4.

The crown and base sections are interconnected by an integral live hinge 32 of the same material as that of sections 21 and 22, or as that of section 22.

The shroud may be molded in its FIG. 4 open position or may be molded in a position in which free edges 23 and 24 of the sections lie in the same plane. Sections 21 and 22, and hinge 32, are of the same molded thermoplastic material or materials such that the shroud is of unitary construction and is articulated such that in use the sections are hinged closed in the FIG. 2 position with their respective free edges 23 and 24 facing one another and preferably, but not necessarily, in abutment. In this position latch bars 25 on section 21 and at latch receptacles 26 on section 22 interengage for latching the upper and lower sections together.

The articulated shroud sections according to the invention can be injection molded using a thermoplastic of a selected color and of a selected hardness.

Otherwise the shroud can be a two-tone part for market appeal, such that sections 21 and 22 are of contrasting and different colors. For this purpose, the shroud is molded using a co-injection molding process which is well known in the plastic molding art. Drawing FIGS. 2, 3, 4, 7 and 8 illustrate contrasting colors by horizontal and vertical shading lines.

Moreover, the shroud may be formed of thermoplastic materials which differ from each other only in hardness but which are otherwise of the same color. For this purpose, a co-injection molding process is carried out for molding the base section 22 of softer and more compliant plastic material compared to that of crown section 21 which is co-molded of a relatively harder material. In such manner a "softer touch" is created for the trigger sprayer when handled during use. The rearwardly extending portion 27, designed to rest upon the top of the operators hand during use, is of softer material which improves upon the comfort and handling ease of the trigger sprayer. This rearwardly extending portion 27 is sometimes referred to as a saddle portion, such that the pump sprayer shroud is of an ergonomic design.

As clearly shown in FIG. 3, the saddle portion 27 is defined by a curved wall section 28 which rests comfortably on the top of the operator's hand. It should be noted also that the rearwardly extending portion mates with a rearward portion 29 of the crown section, portions 27 and 29 being interconnected at a terminal end thereof. It is at this terminal end that hinge 32 is located which comprises an integral living hinge.

The relatively softer and harder thermoplastic materials used for the lower and upper sections 22 and 21 may likewise be of contrasting colors to form a two-tone shroud. This is made possible by the co-injection molding process producing a unitary shroud having one of several different characteristics.

In accordance with another feature of the invention, side walls 33 of crown section 21 can be molded as having one or more through openings 34 therein which may be elongated forming slits as shown in FIGS. 2 and 4. During the co-injection molding process, channels forming ribbons 35 (FIG.7) extend from base section 22 of the shroud along the underside of crown section 21 and underlie slits 34, as in the manner illustrated in FIG. 5, so that portions 36 of ribbons 35 fully occupy the areas defined by openings 34 as to be visible from the exterior of crown section 21. Portions 36 may extend through openings 34 so as to lie slightly recessed from the outer side wall surfaces of the crown section as shown, or may protrude into openings 34 so as to lie flush with the surfaces of side walls 33.

Thus, during the formation of the shroud utilizing a co-injection process for molding the shroud of thermoplastic materials, and selecting a color such as blue for the base section, and selecting a different color such as red for the crown section, the blue elastomer material is exposed through openings 34 of the crown section to give the shroud and the sprayer a striped decorative effect. The shroud cover is nevertheless of one-piece construction, is of two-tone color, and decorative strips are located along side walls of crown section 21, all in a manner which renders production of the shroud highly economical and efficient and while retaining its unitary character.

After the shroud produced as described above leaves the mold, and clamshell sections 21 and 22 are closed together to the position shown in FIG. 2 whereupon bars 25 are snap fitted into receptacles 26 for retaining the crown and base sections in the closed position. Of course, latch means other than bars 25 and receptacles 26 for retaining sections 21 and 22 closed together, may be devised without departing from the invention.

Figure 9:
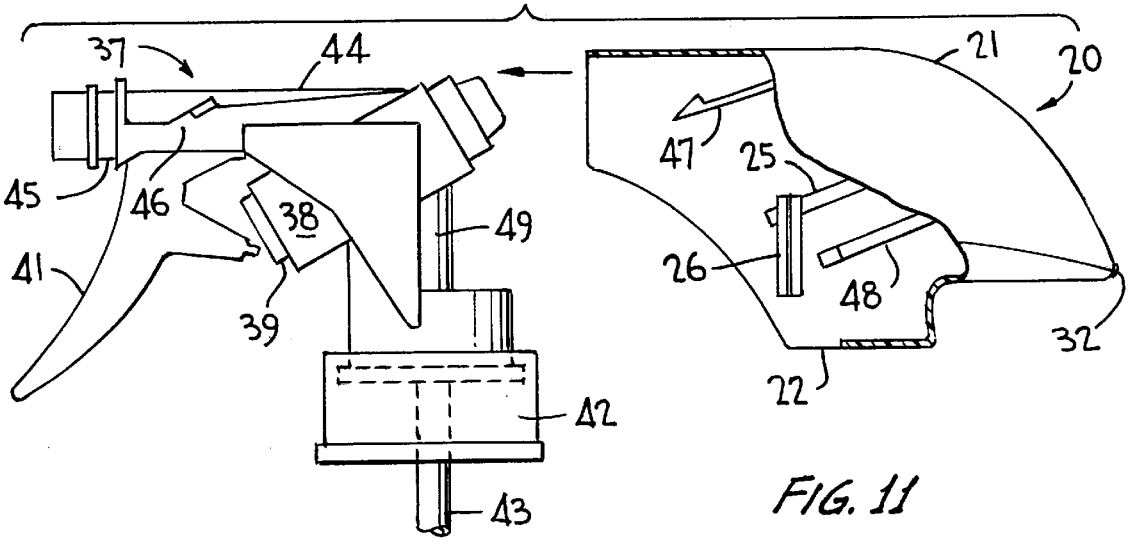
FIG. 9 is an expanded side elevational view of a pump body of a trigger sprayer and the open-fronted shroud of the invention before attachment to the pump body.

The shroud in its closed condition is thereupon assembled to a pump body of specified design and generally designated 37 in FIG. 9. The pump body typically has a pump cylinder 38 for the reception of a pump piston 39 for therewith defining a variable volume pump chamber (not shown), and a trigger lever 41 pivotally mounted to the pump body for reciprocation of the piston within its cylinder against the bias of a return spring (not shown) each time the trigger lever is stroked by the operator as in the normal, well-known manner. The pump body has a closure cap 42 coupled thereto for mounting the trigger sprayer to a container (not shown) of liquid to be sprayed. A dip tube 43 is connected to and depends from an inlet passage located within the pump body, the dip tube extending into the liquid in the container. The inlet passage communicates with the pump chamber, and a discharge barrel 44 of the pump body contains a discharge passage which terminates in a nozzle 45. A nozzle cap (not shown) is mounted to the nozzle to control the spray upon manual rotation of the cap. The pump operates in a well-known manner and therefore need not be described in detail here.

Figure 10:
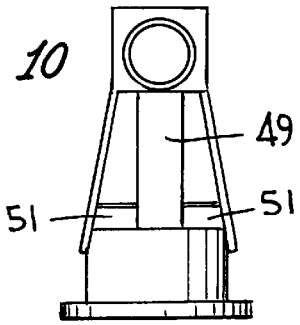
FIG. 10 is a rear elevational view of the pump body of FIG. 9.
Figure 11:
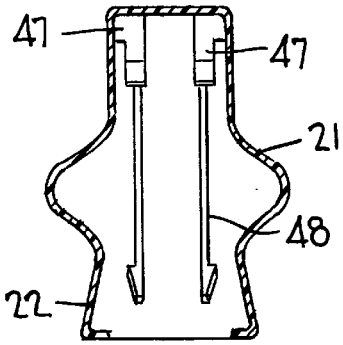
FIG. 11 is a front elevational view of the shroud of FIG. 9.

The pump body has a pair of undercuts defining shoulders 46 on opposite sides of the pump barrel for the reception of latch bars 47 when the shroud is moved toward the pump body in the direction of the arrow of FIG. 9 until the latch bars 47 snap lock with shoulders 46. And the base section 22 of the shroud has a yoke 48 contoured at its free end to abut against the rearward side of the upstanding portion 49 of the pump body with the forked ends snap-fitting into openings 51 (FIG. 10). The shroud cover, when fitting about the pump body, therefore substantially covers the pump body in the normal manner.

From the foregoing it can be seen that the shroud cover according to the invention is of unitary construction which is molded like an open clamshell thereby permitting a more intricate design with reentry molds and the like without the need for the molding of an additional part or parts forming the shroud cover. The crown and base sections of the shroud are interconnected by an integral living hinge. The shroud sections when closed together form a shroud cover defined as having a rearwardly extending crown section and an ergonomic feature which is defined by a lower saddle wall which rests against the upper surface of the operator's hand between the thumb and forefinger supporting the sprayer and the mounted container during use. The living hinge is located at the terminal end of the rearwardly extending saddle portion so as to be disposed substantially transversely to a longitudinal axis of the shroud which is open at its front end. The crown and base sections forming the shroud as integrally connected via the living hinge may be injection molded of a selected thermoplastic material which can be of the same color for the crown and base section as in most trigger sprayer shrouds. Otherwise the crown and base sections forming the shroud can be made by co-injection molding of selected thermoplastic materials. The materials may be of different and contrasting colors respectively for the crown and base sections, which renders the shroud of two-tone coloration. The thermoplastic material for forming the base section may be softer and more compliant compared to that of the material forming the crown section. The "softer touch" and "softer feel" thus provided for the trigger sprayer is made possible while retaining a more rigid characteristic for the upper crown section of the shroud necessary for handling and storage. The co-injected crown and base sections may likewise be of contrasting colors to provide a two-tone coloration for the shroud. And, the crown section may be provided with openings in its side walls which may be in the form of elongated slits, ribbons of the contrasting colored base section material extending from that section to the slits and underlying the slits so as to be visible therethrough from the exterior of the crown section, for aesthetic purposes.

Many other objects and advantages of the present invention are made possible in the light of the above teachings. It is therefore to be understood that within the scope of the appended claims, the invention may be practiced otherwise than as specifically described.

What is claimed is:

1. An open-fronted shroud for a trigger actuated pump sprayer, comprising a unitary element of at least one molded thermoplastic material having a first section and a second base section, both said sections having side walls with facing free edges in a closed position of the shroud , said element having a portion extending away from the open end of said shroud defining a substantially horizontal shelf for supporting the pump sprayer on top of the operator's hand during use, said first and second sections being interconnected by an integral hinge at a terminal end of said portion for pivotal movement between an open position of the sections during molding and the closed position during use.

2. The shroud according to claim 1, wherein the second section material is softer and more compliant than the first section material.

3. The shroud according to claim 1, wherein the second section material is of one color and the first section material is of another color which contrasts with said one color.

4. The shroud according to claim 1, wherein cooperating latch means are provided on said sections which interengage for latching the sections together in the closed position of the shroud.

5. The shroud according to claim 1, wherein said first section is crown section and said second section is a base section and wherein the element comprises thermoplastic materials respectively for the base section and the crown section, the base section material being of one color and the crown section material being of another color, the crown section having a plurality of openings therein, the thermoplastic material of the one color extending from the base section and occupying the slits in the crown section, and said crown and base sections being co-injection molded of the thermoplastic materials.

6. The shroud according to claim 3, wherein one of said first and second sections have an opening therein with the thermoplastic material of the one color extending from the other section and underlying the openings so as to be visible from an outer side of the shroud.

7. A manually actuated pump dispenser for attachment to a container of liquid to be dispensed, comprising a pump body having a variable volume pump chamber defined by a pump cylinder and a reciprocable pump piston, the body having a liquid inlet passage leading to the chamber and a liquid discharge passage leading away from the chamber, a closure member coupled to the pump body for mounting the dispenser to the container, an open-fronted shroud substantially covering the pump body and comprising a one-piece element of molded thermoplastic material having an upper section overlying a top portion of the pump body, and a lower section overlying a lower portion of the pump body adjacent the closure member, the lower section having a rearward extension defining a means for supporting the dispenser on top of an operator's hand during use between the thumb and forefinger, said upper and lower sections being hingedly interconnected by a living hinge at a terminal end of said rearward extension for pivotal movement between an open position during molding and a closed position in use.

8. The pump dispenser according to claim 7, wherein the means for supporting the dispenser on the top of the operator's hand comprises a lower wall lying adjacent the closure member.

9. The pump dispenser according to claim 7, wherein the element comprises different thermoplastic formulations respectively for the upper and lower sections which are co-injected molded, the thermoplastic material for the lower section being softer and more compliant than the upper thermoplastic material which is relatively harder and more rigid.

10. The pump dispenser according to claim 7, wherein the element comprises different thermoplastic formulations respectively for the upper and lower sections which are co-injected molded, the thermoplastic material being of one color for the lower section and of another different color for the upper section.

11. The pump dispenser according to claim 7, wherein said upper and lower sections have confronting edges in abutting engagement in the closed position, and cooperating means on said sections for latching said sections together in said closed position.

12. The pump dispenser according to claim 7, wherein the upper and lower sections are substantially cup-shaped which in the closed position define a closed clamshell.

13. The pump dispenser according to claim 10, wherein the upper section has a plurality of through openings therein, the thermoplastic material of the one color extending from the living hinge to the underside of the upper section to form ribbons of material overlying the through openings so as to be visible from an outer side of the upper section.

* * * * *